US009248066B2

(12) United States Patent
Tsukada et al.

(10) Patent No.: US 9,248,066 B2
(45) Date of Patent: Feb. 2, 2016

(54) WHEELCHAIR AND COMBINED BED

(71) Applicant: Panasonic Intellectual Property Management Co., Ltd., Osaka (JP)

(72) Inventors: Shohei Tsukada, Hyogo (JP); Yohei Kume, Osaka (JP); Hideo Kawakami, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/647,583

(22) PCT Filed: Sep. 12, 2014

(86) PCT No.: PCT/JP2014/004736

§ 371 (c)(1),
(2) Date: May 27, 2015

(87) PCT Pub. No.: WO2015/040846

PCT Pub. Date: Mar. 26, 2015

(65) Prior Publication Data

US 2015/0320627 A1 Nov. 12, 2015

(30) Foreign Application Priority Data

Sep. 17, 2013 (JP) ..... 2013-191418

(51) Int. Cl.
*A61G 7/16* (2006.01)
*A61G 7/10* (2006.01)
(Continued)

(52) U.S. Cl.
CPC *A61G 7/16* (2013.01); *A61G 5/006* (2013.01); *A61G 5/08* (2013.01); *A61G 5/1067* (2013.01); *A61G 7/053* (2013.01); *A61G 2007/165* (2013.01)

(58) Field of Classification Search
CPC ..... A61G 7/002; A61G 7/005; A61G 7/012; A61G 7/015; A61G 7/018; A61G 7/16; A61G 2007/165; A61G 5/10; A61G 5/02; A61G 5/04; A61G 5/08; A61G 2005/0866; A61G 2005/0875; A61G 2005/0883; A61G 2005/0891; A61G 5/00; A61G 5/006; A47C 20/041; A47C 20/04
USPC ..... 5/86.1, 81.1 R, 613, 616, 617, 618, 600; 280/47.38, 47.4, 250.1, 647, 648, 650
See application file for complete search history.

(56) References Cited

U.S. PATENT DOCUMENTS 4,225,988 A * 10/1980 Cary ..... A61G 7/015 5/607
5,063,623 A * 11/1991 Bathrick ..... A61G 7/015 5/616

(Continued)

FOREIGN PATENT DOCUMENTS

EP 2868302 A1 * 5/2015 ..... A61G 7/16
JP 10-52459 2/1998

(Continued)

OTHER PUBLICATIONS

International Search Report issued Dec. 16, 2014 in International (PCT) Application No. PCT/JP2014/004736.

*Primary Examiner* — Robert G Santos
(74) *Attorney, Agent, or Firm* — Wenderoth, Lind & Ponack, L.L.P.

(57) ABSTRACT

A wheelchair includes a first link that supports a first bottom, a second link that supports a second bottom, a third link that supports a third bottom, a fourth link that supports a fourth bottom, a first base portion that supports a fifth bottom, and a first drive link. The first drive link has a first roller and a second roller. The second link and the third link are provided with rail portions respectively. The wheelchair has wheelchair link portion allows the first roller to slide in the rail portion of the second link, and allows the second roller to slide in the rail portion of the third link.

20 Claims, 11 Drawing Sheets

(51) Int. Cl.

| | |
|---|---|
| ***A61G 5/08*** | (2006.01) |
| ***A61G 5/10*** | (2006.01) |
| ***A61G 5/00*** | (2006.01) |
| ***A61G 7/053*** | (2006.01) |

(56) References Cited

U.S. PATENT DOCUMENTS

| | | | | | |
|---|---|---|---|---|---|
| 5,438,723 | A * | 8/1995 | Carroll | A47C 19/122 | 16/267 |
| 5,469,591 | A * | 11/1995 | Nomura | A47C 20/04 | 5/191 |
| 5,568,661 | A * | 10/1996 | Bathrick | A47C 20/041 | 5/285 |
| 5,579,550 | A * | 12/1996 | Bathrick | A47C 19/005 | 5/184 |
| 6,061,852 | A * | 5/2000 | Bathrick | A61G 7/015 | 5/400 |
| 6,101,647 | A * | 8/2000 | Stroud | A47C 20/041 | 5/613 |
| 6,161,236 | A * | 12/2000 | Carroll | A47C 19/045 | 5/611 |
| 6,163,904 | A * | 12/2000 | Royston | A47C 20/041 | 5/600 |
| 6,505,362 | B1 * | 1/2003 | Scipio | A47C 23/065 | 5/118 |
| 6,951,037 | B2 * | 10/2005 | Weinman | A47C 20/041 | 5/200.1 |
| 6,957,460 | B2 * | 10/2005 | Horitani | A61G 7/015 | 5/613 |
| 7,036,165 | B2 * | 5/2006 | Weinman | A61G 7/015 | 5/617 |
| 7,080,439 | B2 * | 7/2006 | Weinman | A47C 20/041 | 29/428 |
| 7,484,254 | B2 * | 2/2009 | Eriksson | A47C 20/041 | 5/616 |
| 7,900,302 | B2 * | 3/2011 | Long | A47C 20/041 | 5/617 |
| 8,474,075 | B2 * | 7/2013 | Kawakami | A61G 5/006 | 5/600 |
| 8,484,781 | B2 * | 7/2013 | Kong | A47C 20/041 | 5/613 |
| 8,677,523 | B2 * | 3/2014 | Tsukada | A61G 5/006 | 5/2.1 |
| 8,677,524 | B2 * | 3/2014 | Kume | A61G 5/04 | 5/613 |
| 8,718,859 | B2 * | 5/2014 | Kume | A61G 5/006 | 180/168 |
| 8,950,776 | B2 * | 2/2015 | Tsukada | A61G 5/006 | 280/30 |
| 9,004,508 | B2 * | 4/2015 | Tsukada | A61G 7/00 | 280/47.4 |
| 9,050,223 | B2 * | 6/2015 | Ohta | A61G 7/018 | |
| 2002/0189015 | A1 * | 12/2002 | Barssessat | A47C 19/024 | 5/620 |
| 2004/0034934 | A1 * | 2/2004 | Weinman | A47C 20/041 | 5/618 |
| 2004/0064891 | A1 * | 4/2004 | Horitani | A61G 7/015 | 5/618 |
| 2004/0194213 | A1 * | 10/2004 | Weinman | A61G 7/015 | 5/618 |
| 2005/0278850 | A1 * | 12/2005 | Weinman | A47C 20/041 | 5/618 |
| 2007/0163046 | A1 * | 7/2007 | Eriksson | A47C 20/041 | 5/618 |
| 2009/0094748 | A1 * | 4/2009 | Long | A47C 20/08 | 5/613 |
| 2009/0211028 | A1 * | 8/2009 | Richmond | A47C 20/041 | 5/618 |
| 2010/0325799 | A1 * | 12/2010 | Huang | A47C 20/041 | 5/616 |
| 2010/0325800 | A1 * | 12/2010 | Huang | A47C 19/022 | 5/618 |
| 2011/0030138 | A1 * | 2/2011 | Kawakami | A61G 5/006 | 5/2.1 |
| 2011/0196562 | A1 * | 8/2011 | Kume | A61G 5/006 | 701/23 |
| 2012/0153687 | A1 | 6/2012 | Kume et al. | | |
| 2012/0159705 | A1 * | 6/2012 | Tsukada | A61G 5/006 | 5/2.1 |
| 2012/0169093 | A1 * | 7/2012 | Kume | A61G 5/04 | 297/118 |
| 2012/0181779 | A1 * | 7/2012 | Tsukada | A61G 5/006 | 280/648 |
| 2013/0074256 | A1 * | 3/2013 | Tsukada | A61G 7/16 | 5/81.1 R |
| 2014/0137328 | A1 * | 5/2014 | Ohta | A61G 7/018 | 5/611 |
| 2014/0191541 | A1 * | 7/2014 | Ohta | A61G 7/16 | 297/118 |
| 2014/0319804 | A1 * | 10/2014 | Tsukada | A61G 7/00 | 280/648 |
| 2015/0082537 | A1 * | 3/2015 | Ohta | A61G 5/04 | 5/2.1 |
| 2015/0107024 | A1 * | 4/2015 | Xu | A47C 20/041 | 5/616 |

FOREIGN PATENT DOCUMENTS

| | | |
|---|---|---|
| JP | 2002-238953 | 8/2002 |
| JP | 2007-82937 | 4/2007 |
| JP | 3139367 | 2/2008 |
| WO | 2011/155177 | 12/2011 |

* cited by examiner

WHEELCHAIR AND COMBINED BED

TECHNICAL FIELD

The present invention relates to a wheelchair combined to form a part of a bed, and a combined bed.

BACKGROUND ART

Upon nursing care of a bedridden aged person or an ailing person (hereinafter collectively referred to as a "care receiver"), work for transferring a care receiver from a wheelchair to abed is called transfer work. This transfer work becomes a large burden on a caregiver. In order to reduce this burden, there is a combined bed capable of separating a part of the bed (wheelchair portion). When the wheelchair portion that forms a part of the combined bed is used as a bed, a bottom thereof needs to become horizontal. Therefore, as the wheelchair portion, a reclining wheelchair whose angle on a leg side varies so as to be interlocked with an angle of a back is required. The reclining wheelchair is disclosed in, for example, Patent Literature 1.

FIG. 8 and FIG. 9 each illustrate a wheelchair 6 of Patent Literature 1. A back portion 7*a* is fallen, so that all of a bottom portion 7*b*, a calf portion 7*c*, and a footrest portion 7*d* that are coupled by interlocking links 8 are made to be the same horizontal plane, thereby allowing this wheelchair 6 to take a flat posture. FIG. 9 is a side view of the wheelchair 6 that is in the flat posture. Thus, a caregiver can change a posture of the wheelchair 6 from a chair posture to the flat posture by utilizing the interlocking links 8.

It is conceivable to forma combined bed by applying such a reclining wheelchair 6 as a wheelchair portion.

CITATION LIST

Patent Literature

Patent Literature 1 JP 10-52459 A

SUMMARY OF INVENTION

Technical Problem

However, in a case of a combined bed, components of a bed such as a lifting link need to be disposed vertically below a posture changing link of a wheelchair in order to make the combined bed function as a bed after combination. Therefore, when vertically downward protrusions, such as the interlocking links 8 and the calf portion 7*c* are present like the wheelchair 6 of Patent Literature 1, it is difficult to function as a combined bed.

The present invention solves such a problem, and an object of the present invention is to provide a wheelchair that is easily combined with a bed, and a combined bed.

Solution to Problem

In order to solve the above problem, a wheelchair according to an aspect of the present invention is characterized by comprising:

a wheelchair bottom portion constituted by coupling a first bottom, a fifth bottom, a second bottom, a third bottom, and a fourth bottom;

a first link configured to support the first bottom;

a second link configured to support the second bottom;

a third link configured to support the third bottom;

a fourth link configured to support the fourth bottom;

a first base portion configured to support the fifth bottom;

a first drive link configured to interlock and move the second link and the third link; and a first coupling link configured to couple the first link and the first drive link, and move the first drive link interlocking with movement of the first link, wherein the first drive link has a first end that is disposed with a first roller slidable with respect to the second link, and has a second end that is disposed with a second roller slidable with respect to the third link.

In order to solve the above problem, a combined bed according to another aspect of the present invention is characterized by comprising:

the wheelchair; and a bed port ion having a bed bottom portion constituted by coupling a seventh bottom, an eighth bottom, a ninth bottom, and a tenth bottom, the bed portion being combined with the wheelchair to constitute the combined bed, wherein the bed portion has a lifting unit located below the third link at a time of combination and configured to lift the ninth bottom.

Advantageous Effects of Invention

According to each of aspects of the present invention, it is possible to provide the wheelchair that is easily combined with the bed, and the combined bed.

DESCRIPTION OF EMBODIMENTS

Figure 1A:
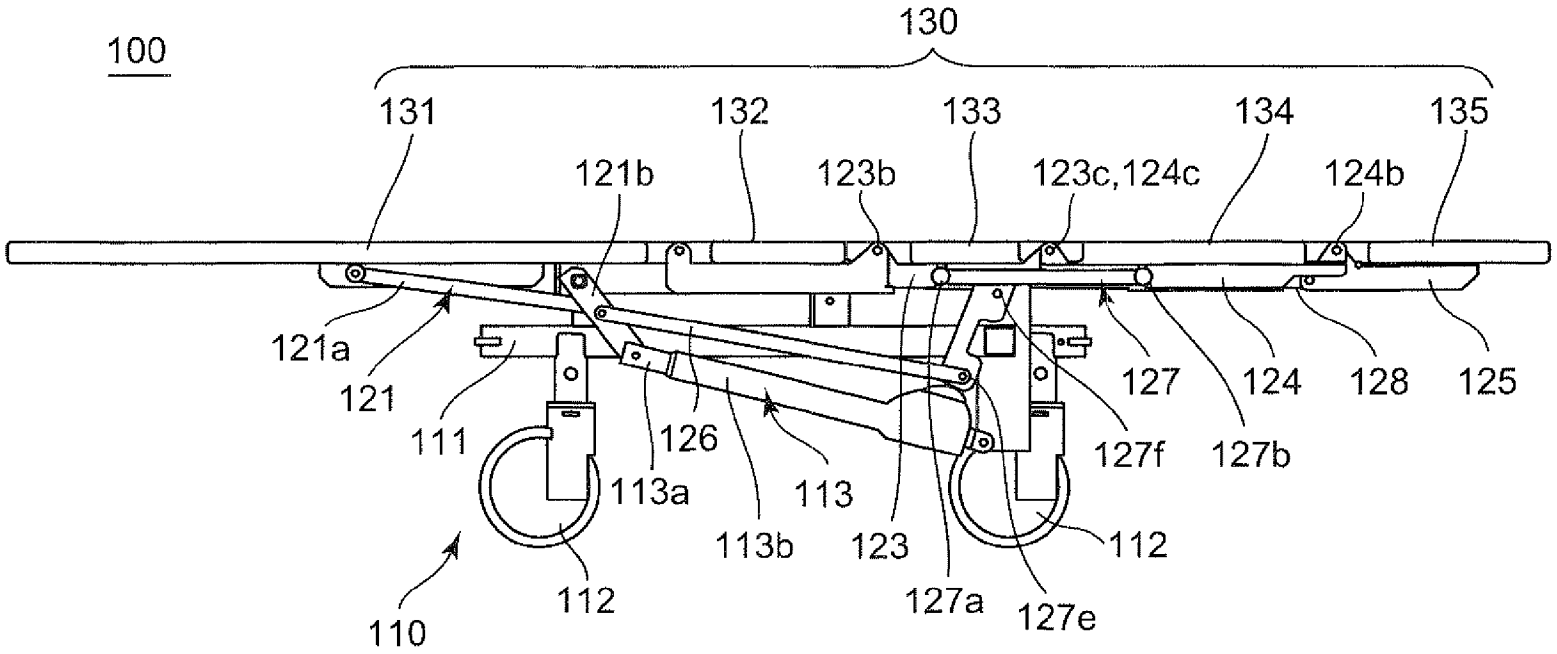
FIG. 1A is a side view of a flat posture of a wheelchair according to a first embodiment of the present invention.

Hereinafter, an embodiment of the present invention is described with reference to the drawings. The same components are denoted by the same reference numerals, and description thereof is sometimes omitted. In order to facilitate understanding, the drawings schematically mainly illustrate the respective components.

FIG. 1A is a side view of a flat posture of a wheelchair according to a first embodiment of the present invention. FIG.

1B is a side view of a chair posture of the wheelchair. Herein, the chair posture is a chair shaped posture in which a thigh part is inclined upward, and a footrest part is formed, as illustrated in FIG. 1B.

Figure 1B:
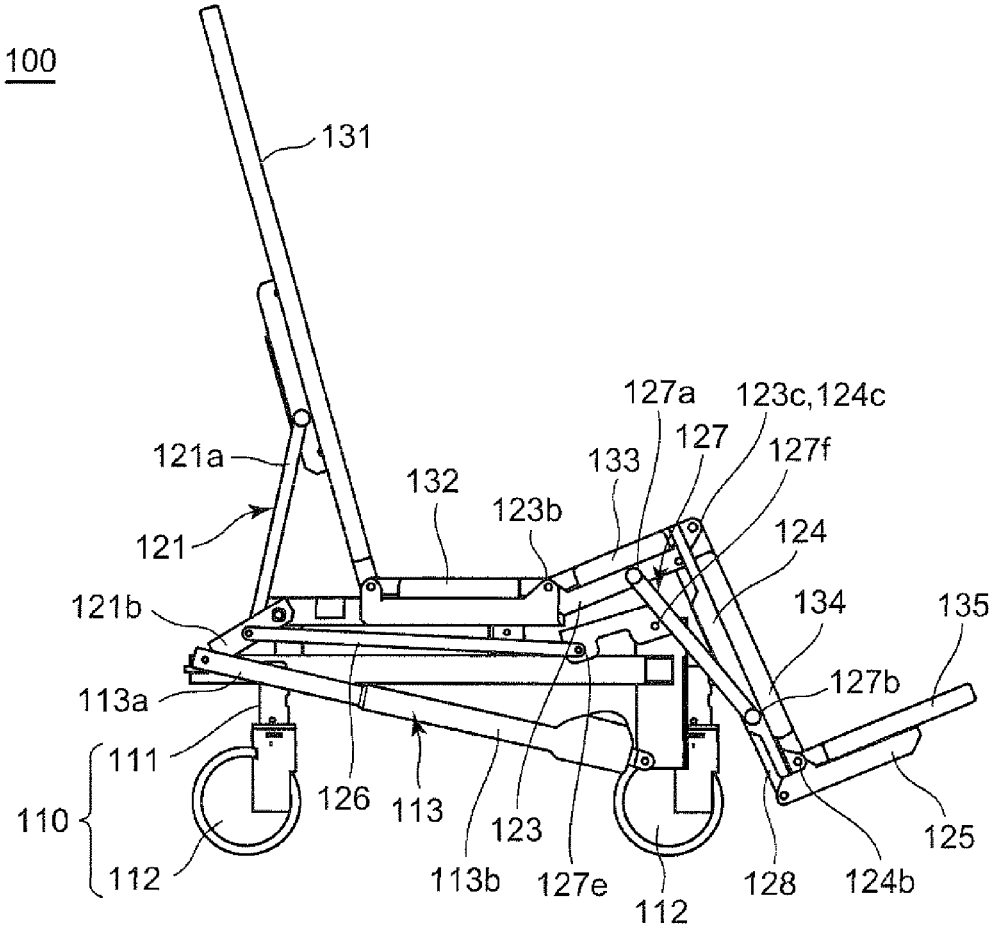
FIG. 1B is a side view of a chair posture of the wheelchair according to the first embodiment of the present invention.

As illustrated in FIG. 1A to FIG. 1B, a wheelchair 100 includes a wheelchair bottom portion 130 (see FIG. 4), a wheelchair link portion 120 (see FIG. 4), and a first base portion. 110. The wheelchair bottom portion 130 specifically includes a first bottom 131, a fifth bottom 132, a second bottom 133, a third bottom 134, and a fourth bottom 135 that are disposed from a rear end to a front end of the wheelchair 100. Herein, the wheelchair bottom portion 130 is an example of a sixth bottom that is an entire bottom of the wheelchair. The wheelchair link portion 120 is an example of a fifth link that is an entire link of the wheelchair. The first base portion 110 is an example of a wheelchair base portion that supports the wheelchair bottom portion 130. The first bottom 131 is an example of a wheelchair back bottom that is a bottom on a back side of the wheelchair. The fifth bottom 132 is an example of a wheelchair hip bottom that is a bottom on a hip side of the wheelchair. The second bottom 133 is an example of a wheelchair thigh bottom that is a bottom on a thigh side of the wheelchair. The third bottom 134 is an example of a wheelchair calf bottom that is a bottom on a calf side of the wheelchair. The fourth bottom 135 is an example of a wheelchair foot bottom that is a bottom on a foot side of the wheelchair.

In the wheelchair 100, the wheelchair link portion 120 is disposed closer to one side in a width direction of the wheelchair 100 (left side in FIG. 4) with respect to the wheelchair bottom portion 130. On a side on which the wheelchair link portion 120 is not disposed, the wheelchair bottom portion 130 is supported by a bed link portion 220 from a lower side when the wheelchair 100 is combined with a bed portion 200. The bed link portion 220 is an example of a sixth link that is an entire link of the bed portion 200. The wheelchair link portion 120 is specifically composed of a first link 121, a second link 123, a third link 124, and a fourth link 125 that are disposed from the rear end to the front end of the wheelchair 100. The first link 121 is an example of a wheelchair back link 121 that is a link on the back side of the wheelchair. The second link 123 is an example of a wheelchair thigh link that is a link on the thigh side of the wheelchair. The third link 124 is an example of a wheelchair calf link that is a link on the calf side of the wheelchair. The fourth link 125 is an example of a wheelchair foot link that is a link on the foot side of the wheelchair. The first link 121 is composed of a substantially T-shaped member having a second member 121*b*, and a first member 121*a* fixed so as to obliquely extend from the center of this second member 121*b*. An end of the first member 121*a* (rear end) is rotatably coupled to an intermediate portion in a longitudinal direction of a back surface of the first bottom 131. A first end (upper end) of the second member 121*b* is rotatably coupled to a rear end of a third frame 111. A second end (lower end) of the second member 121*b* is rotatably coupled to a tip (rear end) of a driving rod 113*a* of a linear motion actuator 113 described later. An intermediate portion of the second member 121*b* is rotatably coupled to a rear end of a first coupling link 126. The third frame 111 is an example of a wheelchair frame that is a frame of the wheelchair. The first coupling link 126 is an example of a wheelchair coupling link that couples a plurality of links of the wheelchair.

The second link 123 has a rear end that is rotatably coupled to a front end of the third frame 111, and has a front end that is rotatably coupled to a rear end of the third link 124, as described later. The third link 124 has a rear end that is rotatably coupled to a front end of the second link 123, and has a front end that is rotatably coupled to a rear end of the fourth link 125. The fourth link 125 has a rear end that is rotatably coupled to a front end of the third link 124. The first base portion 110 includes the third frame 111, and a plurality of wheels 112 that are rotatably disposed in a lower end of the third frame 111.

With such a configuration, the first link 121 supports the first bottom 131. The second link 123 supports the second bottom 133. The third link 124 supports the third bottom 134. The fourth link 125 supports the fourth bottom 135. The first base portion 110 supports the fifth bottom 132 from below.

The respective adjacent bottoms among the first bottom 131, the fifth bottom 132, the second bottom 133, the third bottom 134, and the fourth bottom 135 are bendably coupled to each other, thereby constituting the wheelchair bottom portion 130. The respective adjacent links among the second link 123, the third link 124, and the fourth link 125 are bendably coupled to each other, thereby constituting the wheelchair link portion 120. The third frame 111 bendably couples the first link 121 and the second link 123. The fifth bottom 132 and the second bottom 133 constitute a twelfth bottom. The twelfth bottom is an example of a wheelchair seat bottom that is a bottom of a seat portion of the wheelchair.

Furthermore, the wheelchair link portion 120 of the wheelchair 100 has the first coupling link 126, a first drive link 127, and a second drive link 128. The first drive link 127 is later described in detail, but is an example of a wheelchair thigh-calf link that interlocks and drives the second link 123 that is a link on the thigh side of the wheelchair, and the third link 124 that is a link on the calf side of the wheelchair. The second drive link 128 is an example of a wheelchair foot drive link that drives the fourth link 125 on the foot side of the wheelchair. Each coupling part of the links, or each coupling part of the link and other member is rotatable. The first coupling link 126 couples the first link 121 and the first drive link 127. The first drive link 127 is rotatably coupled to the front end of the third frame 111. The second drive link 128 couples the second link 123 and the fourth link 125. By the second drive link 128, the second link 123 and the third link 124 are each located along a horizontal direction at the time of a flat posture of the wheelchair 100, and are each bent at the time of a chair posture.

When the linear motion actuator 113 drives to raise the first link 121, the first coupling link 126 pulls the first drive link 127 to rotate the first drive link 127 clockwise in FIG. 1A, so that the second link 123 and the third link 124 each take a posture shown in FIG. 1B. Additionally, when the linear motion actuator 113 reversely drives to fall the first link 121, the first coupling link 126 pushes the first drive link 127 to rotate the first drive link 127 counterclockwise in FIG. 1A, so that the second link 123 and the third link 124 each become horizontal.

Herein, in the first embodiment, a mechanism including the first link 121, the second link 123, the third link 124, the fourth link 125, the first coupling link 126, the first drive link 127, and the second drive link 128 is defined as a first link mechanism that is an example of a wheelchair posture forming link mechanism for forming a posture of the wheelchair.

The wheelchair 100 includes the linear motion actuator 113 that performs expanding/contracting operation by advancing/retreating of the driving rod 113*a* with respect to a casing 113*b*. The linear motion actuator 113 has a first end (front end) that is bendably coupled to the third frame 111, and has a second end (rear end) that is bendably coupled to the first link 121. The driving rod 113*a* of the linear motion actuator 113 extends from the casing 113*b*, so that the wheelchair 100 transforms from the flat posture to the chair posture through the first link mechanism such as the first link 121. On the other hand, the driving rod 113*a* of the linear motion actuator 113 is contracted into the casing 113*b*, so that the wheelchair 100 transforms from the chair posture to the flat posture through the first link mechanism such as the first link 121.

The linear motion actuator 113 is an example of a linear motion mechanism. Examples of the linear motion mechanism other than the linear motion actuator include a linear motion structure utilizing a gas spring.

By disposing the linear motion actuator 113 such that the linear motion actuator 113 couples the third frame 111 and the first drive link 127 in place of the first coupling link 126, the first bottom 131 and the third bottom 134 may be separately operable.

Figure 2:
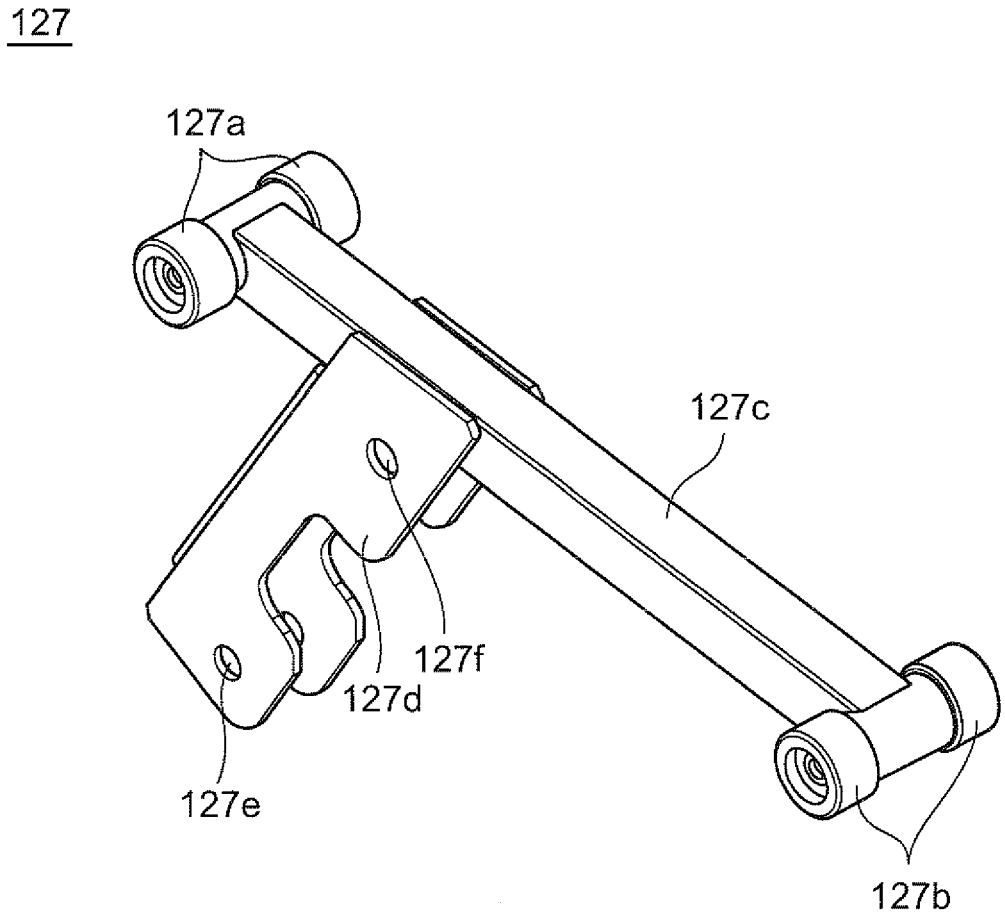
FIG. 2 is a perspective view of a first drive link according to the first embodiment.
Figure 3A:
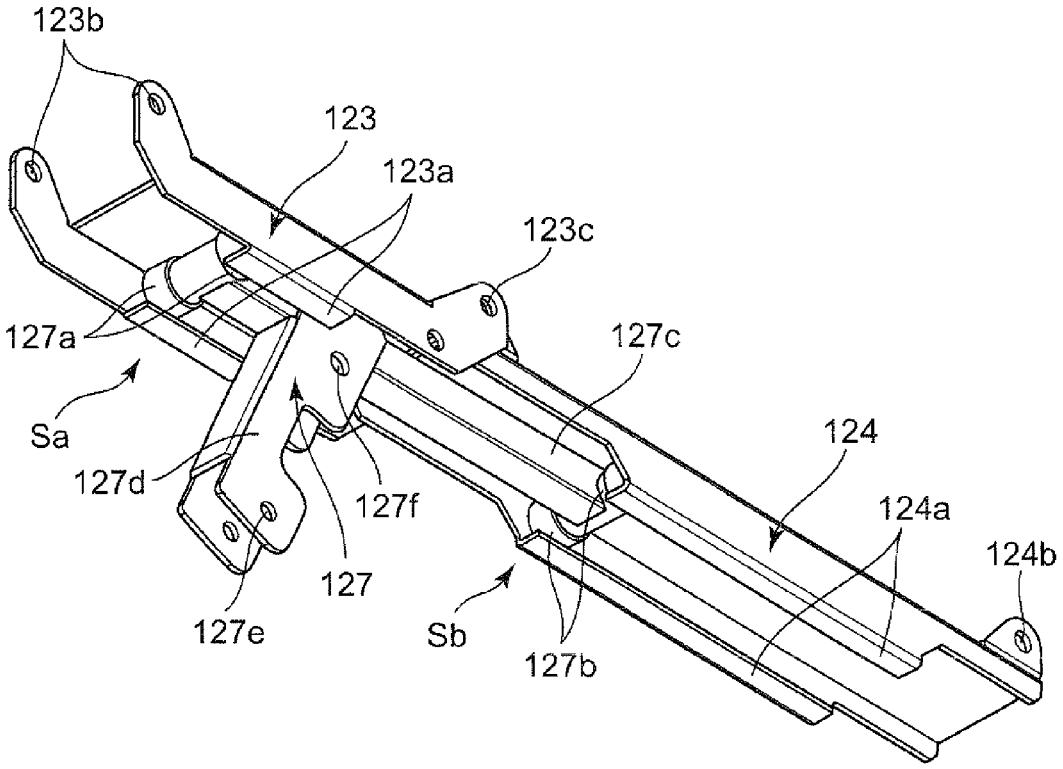
FIG. 3A is a partial perspective view of a first link mechanism in a flat posture according to the first embodiment.
Figure 3B:
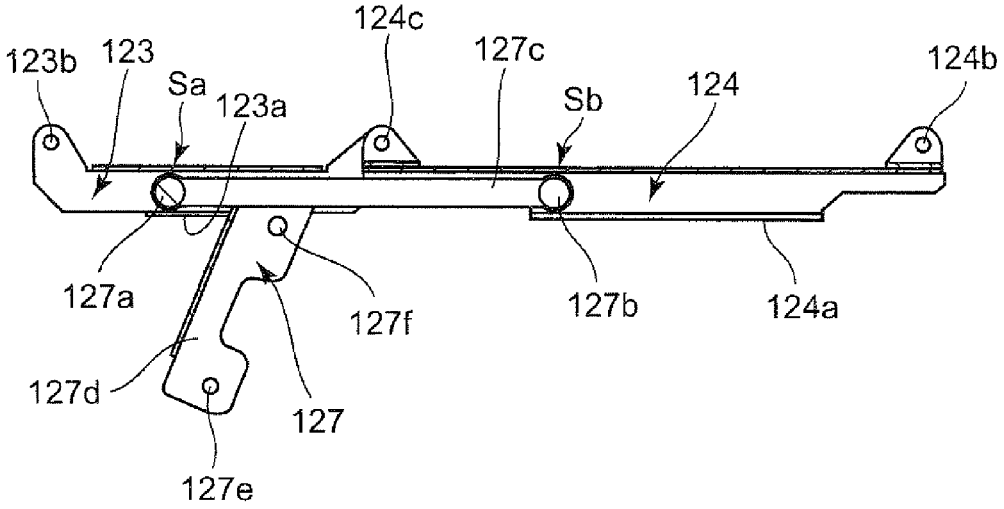
FIG. 3B is a partial side view of the first link mechanism in the flat posture according to the first embodiment.
Figure 3C:
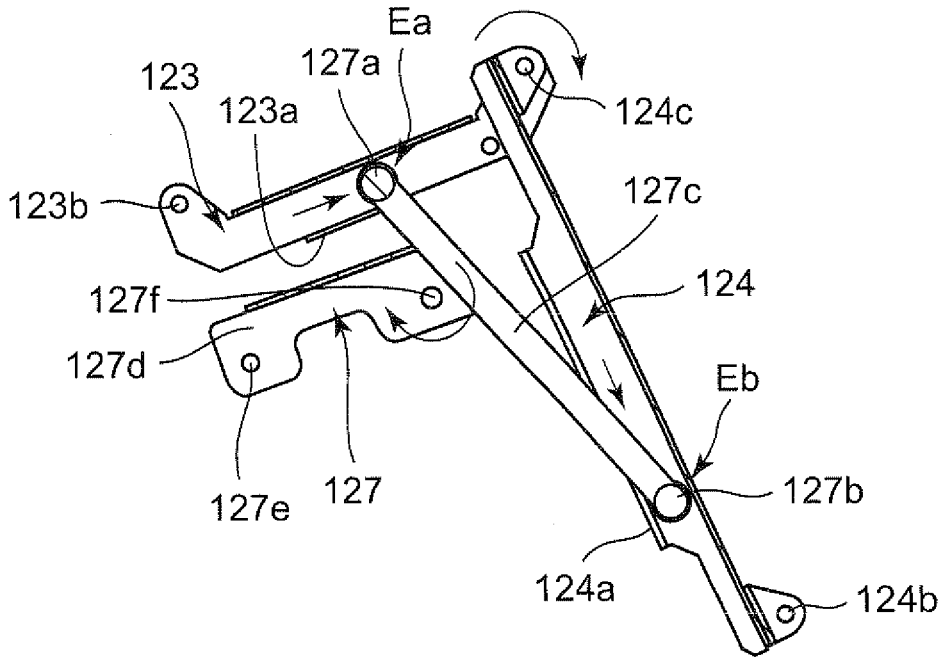
FIG. 3C is a partial side view of the first link mechanism in a chair posture according to the first embodiment.

FIG. 2 is a perspective view of the first drive link 127 according to the first embodiment. FIG. 3A is a partial perspective view of the first link mechanism in the flat posture according to the first embodiment. FIG. 3B is a partial side view of the first link mechanism in the flat posture. FIG. 3C is a partial side view of the first link mechanism in the chair posture. In FIG. 3B and FIG. 3C, first rollers 127*a*, second rollers 127*b*, and a first frame 127*c* are illustrated so as to be visible in order to easily understand a configuration and operation.

By using FIG. 2 to FIG. 3C, operation of the first drive link 127 is described. The first drive link 127 includes a pair of the first rollers 127*a*, a pair of the second rollers 127*b*, the first frame 127*c*, and a second frame 127*d*. The first rollers 127*a* each are an example of a thigh sliding roller that slides in a rail portion of the second link 123 on the thigh side of the wheelchair. The second rollers 127*b* each are an example of a calf sliding roller that slides in a rail portion of the third link 124 on the calf side of the wheelchair. The first frame 127*c* is a long columnar member, has a first end (rear end) that is unrotatably or rotatably disposed with the pair of first rollers 127*a*, and has a second end (front end) that is unrotatably or rotatably disposed with the pair of second rollers 127*b*. In the first frame 127*c*, the second frame 127*d* is fixed at an intermediate position between the first rollers 127*a* and the second rollers 127*b* so as to protrude. That is, the first frame 127*c* and the second frame 127*d* are disposed so as to constitute a Y-shaped member. In a first end (lower end) of the second frame 127*d* opposite to the first frame 127*c*, a first coupling hinge 127*e*, to which a front end of the first coupling link 126 is rotatably coupled, is disposed. In the second frame 127*d*, a frame hinge 1271 is disposed between the first coupling hinge 127*e*, to which the first coupling link 126 is coupled, and the first frame 127*c*. The frame hinge 127*f* is rotatably coupled to a rear end of the third frame 111, and serves as the center of normal/reverse rotation of the first drive link 127 with respect to the third frame 111. The first coupling hinge 127*e* and the frame hinge 1271 are illustrated as respective through holes for coupling hinges, while hinges themselves are not illustrated. Consequently, with such a configuration, the frame hinge 127*f* serving as the rotating center of the first drive link 127 is disposed to a side closer to the first coupling hinge 127*e* serving as a coupling point of the first drive link 127 and the first coupling link 126 than a line connecting the rotation center of the first roller 127*a* and the rotation center of the second roller 127*b*.

As illustrated in FIG. 3A, the wheelchair 100 of the first embodiment has rail portions 123*a* and 124*a* each having a U-shaped (C-shaped) cross section in a width direction, at an intermediate portion of the second link 123 and an intermediate portion of the third link 124, respectively. The rail portions 123*a* and 124*a* are constituted such that the first rollers 127*a* and the second rollers 127*b* are slidable (movable forward and backward) in these rail portions 123*a* and 124*a* along respective longitudinal directions between start points (start point positions) Sa and Sb on the back side, and end points (end point positions) Ea and Eb on the food side, respectively. The rail portions 123*a* and 124*a* are constituted so as not to come into contact with the first frame 127*c* when the first rollers 127*a* and the second rollers 127*b* slide.

As illustrated in FIG. 3A and FIG. 3B, when the wheelchair 100 takes the flat posture, the first frame 127*c* is located along the horizontal direction, and the second link 123 and the third link 124 are each located along the horizontal direction.

The second link 123 has a second coupling hinge 123*b* that is rotatably coupled to the front end of the third frame 111, at a rear end (left end of the second link 123 in FIG. 3A and FIG. 3B), and has a third coupling hinge 123*c* that is rotatably coupled to a fifth coupling hinge 124*c* located at the rear end of the third link 124 (left end of the third link 124 in FIG. 3A and FIG. 3B), at a front end (right end of the second link 123 in FIG. 3A and FIG. 3B). The third link 124 has a fourth coupling hinge 124*b* that is rotatably coupled to the fourth link 125, at a front end right end of the third link 124 in FIG. 3A and FIG. 3B).

When the driving rod 113*a* of the linear motion actuator 113 extends from the casing 113*b*, and the first link 121 rises up in order to transform the wheelchair 100 from the flat posture to the chair posture, the first drive link 127 is pulled by the first coupling link 126 to rotate clockwise around the frame hinge 127*f* in FIG. 3C. Consequently, as illustrated by respective arrows in FIG. 3C, the pair of first rollers 127*a* slides from the start point Sa on the back side to the end point Ea on the toe side in the rail portion 123*a*, to go up to a position above a position in the flat posture, and the pair of second rollers 127*b* slides from the start point Sb on the back side to the end point Eb on the toe side in the rail portion 124*a*, to lower to a position below a position in the flat posture. By this operation, the second link 123 goes up to the position above the position in the flat posture, and the third link 124 lowers up to the position below the position in the flat posture, so that the wheelchair 100 transforms to the chair posture.

On the contrary, when the wheelchair 100 is transformed from the chair posture to the flat posture, reverse operation is performed. That is, when the driving rod 113*a* of the linear motion actuator 113 contracts in the casing 113*b*, and the first link 121 falls in order to transform the wheelchair 100 from the chair posture to the flat posture, the first drive link 127 is pushed by the first coupling link 126 to rotate counterclockwise around the frame hinge 127*f* in FIG. 3C. Consequently, as illustrated in FIG. 35, the pair of first rollers 127*a* slides from the end point Ea on the toe side to the start point Sa on the back side in the rail portion 123*a*, to lower to a position lower than a position in the chair posture, and the pair of second rollers 127*b* slides from the end point Eb on the toe side to the start point Sb on the back side in the rail portion 124*a*, to go up to a position above a position in the chair posture. As a result, as illustrated in FIG. 3A and FIG. 3B, the first frame 127*c* is located along the horizontal direction, and the second link 123 and the third link 124 are each located along the horizontal direction.

As illustrated in FIG. 2 to FIG. 3C, according to this configuration, in the wheelchair 100 of this embodiment, downward protrusion of the third link 124 from the wheelchair 100 in the flat posture can be greatly reduced. This is because a region necessary for a mechanism that drives the second link 123 and the third link 124 is only a region for the rail portions 123*a* and 124*a* for sliding the first rollers 127*a* and the second rollers 127*b*, by using the first drive link 127 having the first rollers 127*a* and the second rollers 127*b*, the second link 123, and the third link 124.

Additionally, the second link 123 and the third link 124 can be operated by a single link by using the first drive link 127, and it is possible to attain reduction in the number of components, reduction in cost, and reduction in weight.

Figure 4:
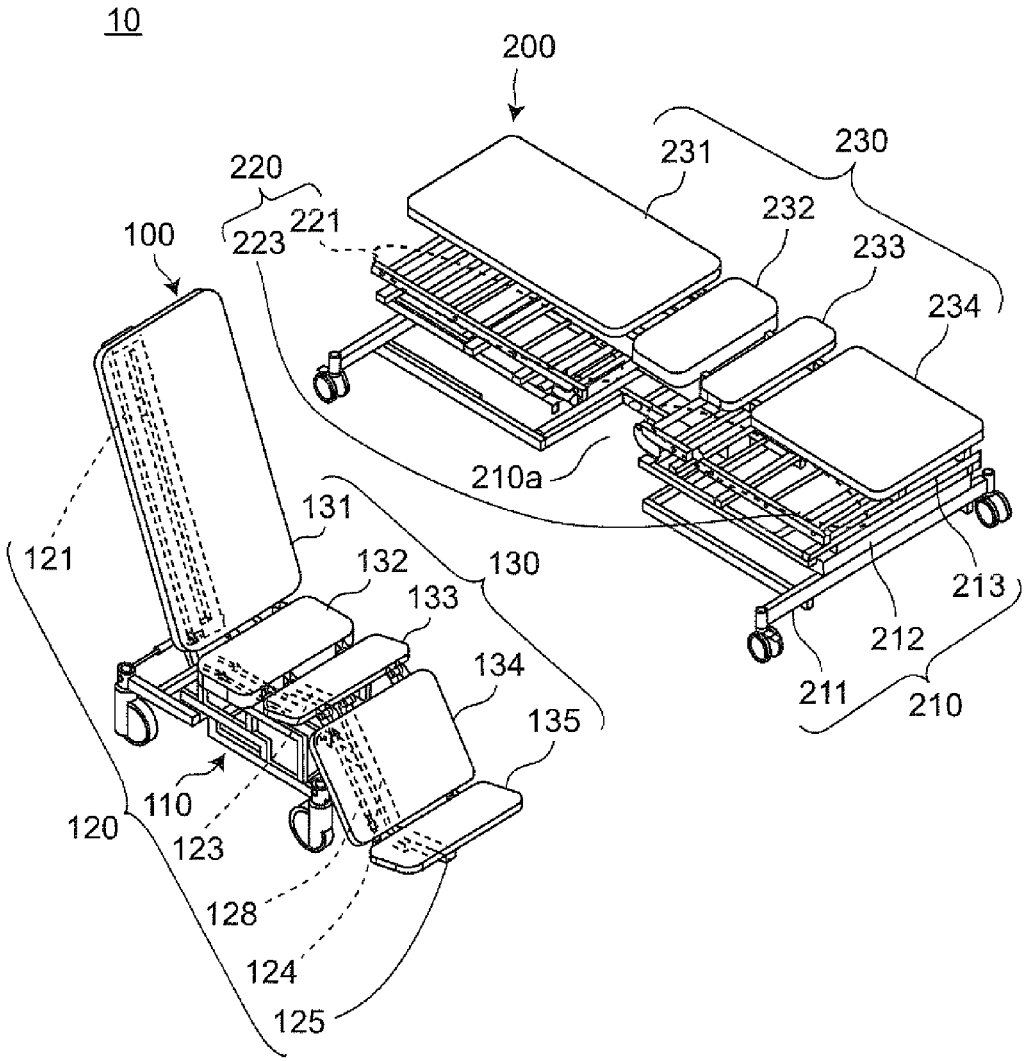
FIG. 4 is a perspective view of a combined bed according to the first embodiment.

FIG. 4 is a perspective view of a combined bed 10 according to the first embodiment. By using FIG. 4, the combined bed 10 is described. The combined bed 10 is constituted by combining the wheelchair 100 with the bed portion 200.

The bed portion 200 has a bed bottom portion 230, the bed link portion 220 that supports this bed bottom portion 230, and a second base portion 210 that fixes this bed link portion 220. The bed bottom portion 230 is an example of an eleventh bottom that constitutes an entire bottom (bed bottom portion) of the bed portion 200. The second base portion 210 is an example of a bed base portion that constitutes a base of the bed portion 200. The bed portion 200 has a lifting unit 212 that is located below the third link 124, described later, at the time of combination, and moves up and down at least a ninth bottom 233.

The bed bottom portion 230 is constituted by bendably coupling respective adjacent bottoms among a seventh bottom 231, an eighth bottom 232, the ninth bottom 233, and a tenth bottom 234 each disposed along a longitudinal direction of the bed portion 200. The seventh bottom 231 is an example of a bed back bottom that is a bottom on the back side of the bed portion 200. The eighth bottom 232 is an example of a bed hip bottom that is a bottom on the hip side of the bed portion 200. The ninth bottom 233 is an example of a bed thigh bottom that is a bottom on the thigh side of the bed portion 200. The tenth bottom 234 is an example of a bed foot bottom that is a bottom on the foot side of the bed portion 200.

The bed link portion 220 includes a seventh link 221 and an eighth link 223 that are disposed along the longitudinal direction of the bed portion 200. The seventh link 221 is an example of a bed back link that is a link on the back side of the bed portion 200 that supports the seventh bottom 231 and the like. The eighth link 223 is an example of a bed foot link that is a link on the foot side of the bed portion 200 that supports the ninth bottom 233, the tenth bottom 234, and the like. In FIG. 4, only an exposed portion other than a part covered with the seventh bottom 231 (region of about right half in a bed width direction in FIG. 4) in the seventh link 221 is illustrated as a first dotted line part by being surrounded by dotted lines. This first dotted line part is covered with the first bottom 131 of the wheelchair 100 at the time of combination of the bed portion 200 and the wheelchair 100, the seventh bottom 231 and the first bottom 131 are integrally moved up and down and bent by the seventh link 221. Only an exposed portion other than a part covered with the ninth bottom 233 and the tenth bottom 234 (region of about right half in the bed width direction in FIG. 4) in the eighth link 223 is illustrated as a second dotted line part by being surrounded by dotted lines.

The second base portion 210 includes a fourth frame 211, the lifting unit 212, and a fifth frame 213. The fourth frame 211 is an example of a bed base frame that is a frame on a base side of the bed portion 200. The fifth frame 213 is an example of a bed upper frame that is a frame on an upper side of the bed portion 200. The lifting unit 212 is mounted on the fourth frame 211 installed so as to be movable on a floor by wheels or the like, and the fifth frame 213 is installed on the lifting unit 212. The fifth frame 213 is lifted up with respect to the fourth frame 211 by the lifting unit 212, thereby moving up and down the bed. Additionally, the bed link portion 220 and the bed bottom portion 230 are fixed to the fifth frame 213. On a left portion of an intermediate portion of the second base portion 210, a recessed portion 210*a* is formed. The first base portion 110 enters this recessed portion 210*a* to be fixed to the second base portion 210, thereby completing the combination of the wheelchair 100 and the bed portion 200 to form the combined bed 10.

Operation for forming the combined bed 10 is described. In order to combine the wheelchair 100 with the bed portion 200, the linear motion actuator 113 is first driven to allow the wheelchair 100 to take the flat posture. Then, the wheelchair 100 is moved such that the first base portion 110 enters the recessed portion 210*a* of the second base portion 210. After the first base portion 110 of the wheelchair 100 in the flat posture completely enters the recessed portion 210*a* of the second base portion 210, the lifting unit 212 rises the fifth frame 213, to lift up the bed link portion 220 and the bed bottom portion 230. Through this lift-up operation, the first base portion 110 is supported and fixed to be raised from below along with the bed link portion 220 and the bed bottom portion 230 by the fifth frame 213, thereby completing the combination of the wheelchair 100 and the bed portion 200.

Figure 5:
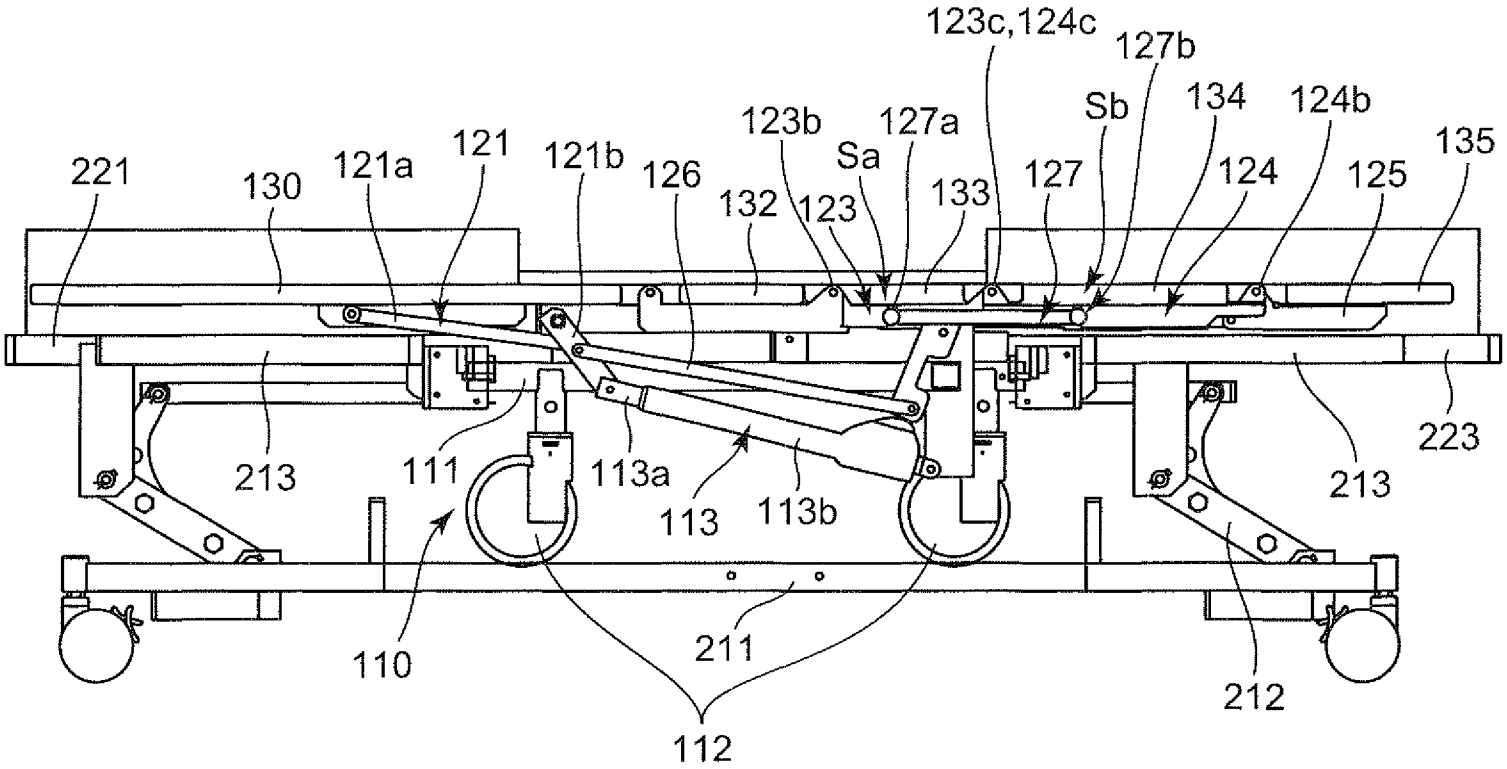
FIG. 5 is a side view of a combined state of the combined bed according to the first embodiment.

FIG. 5 is a side view of the combined bed 10 in a combined state according to the first embodiment. As illustrated in FIG. 5, in the combined state of the first embodiment, the eighth link 223 and the fifth frame 213 are disposed below the third link 124. Herein, for example, in a case where the third link protrudes downward like a conventional configuration, it is necessary to avoid interference of the fifth frame 213 or the lifting unit 212 with the third link. In order to avoid the interference, it is necessary to reduce a width in a shoulder width direction when a care receiver is laid down on the fifth frame 213. However, when a width of the fifth frame 213 is reduced, a width of the lifting unit 212 is also reduced, thereby lowering rigidity of lifting unit 212. That is, it is necessary to lift up the wheelchair 100 particularly in combination, and therefore the lifting unit 212 is required to have higher rigidity than a regular caring bed. However, in a case where the third link 124 protrudes downward, it is difficult to secure the rigidity.

Contrary to this, in the first embodiment, at the time of the flat posture, the second link 123 and the third link 124 are each located along the horizontal direction, the rollers 127*a* and 127*b* of the first drive link 127 are located in only the rail portions 123*a* and 124*a* of the second link 123 and the third link 124, respectively, and the first drive link 127 does not protrude below the third link 124 at all. Therefore, with the configuration of the first embodiment, no member protrudes below the third link 124, and it is possible to constitute the combined bed 10 capable of minimizing the downward protrusion of the third link 124. The third link 124 does not greatly protrude downward at the time of the flat posture, and therefore it is possible to avoid the interference of the fifth frame 213 or the lifting unit 212 with the third link 124.

Figure 6:
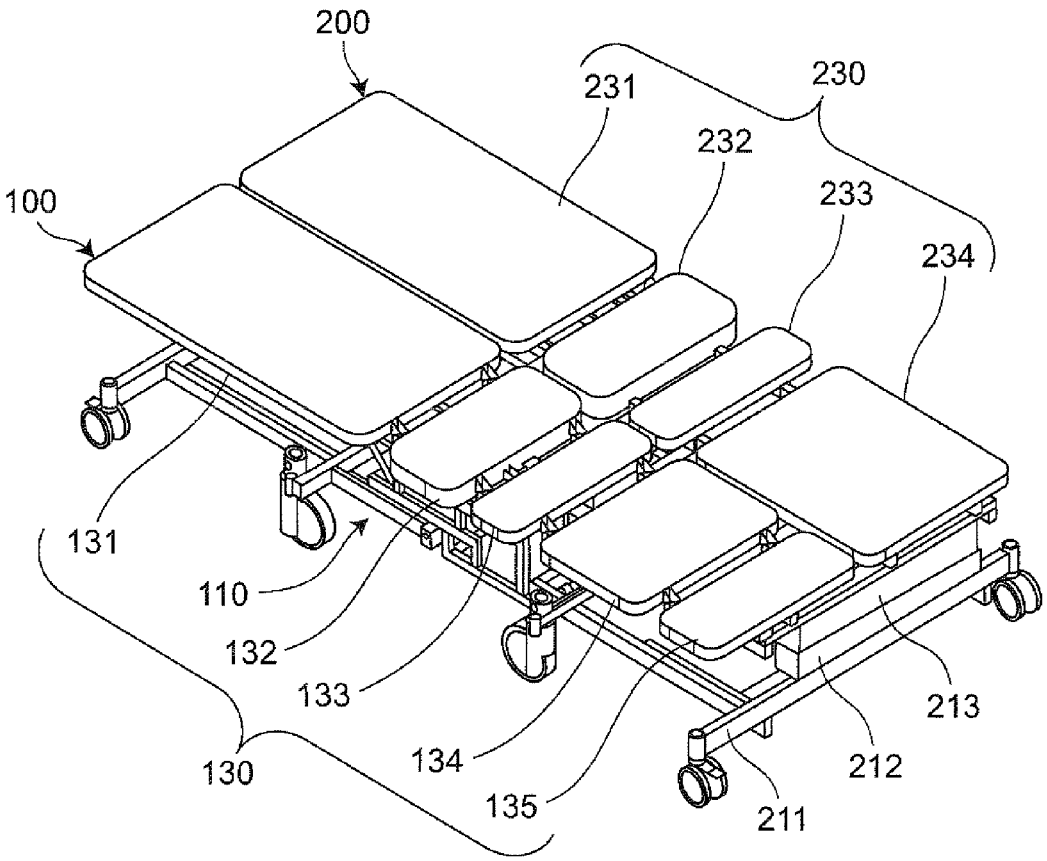
FIG. 6 is a perspective view of the combined state of the combined bed according to the first embodiment.

FIG. 6 is a perspective view of the combined bed 10 in a combined state according to the first embodiment. When the wheelchair 100 is combined with the bed portion 200, the wheelchair bottom portion 130 and the bed bottom portion 230 are integrated to form a bottom portion as the combined bed 10. In the first embodiment, as illustrated in FIG. 6, bendably coupled joint portions between the respective bottoms are arranged on the same straight line so as to be bendable as a bed when the wheelchair 100 is combined with the bed portion 200. With such a configuration, even the bottom portion including the wheelchair bottom portion 130 and the bed bottom portion 230 is bendable. Even the combined bed 10 composed of the wheelchair 100 and the bed portion 200 can take the back lifting posture and the knee lifting posture.

Figure 7:
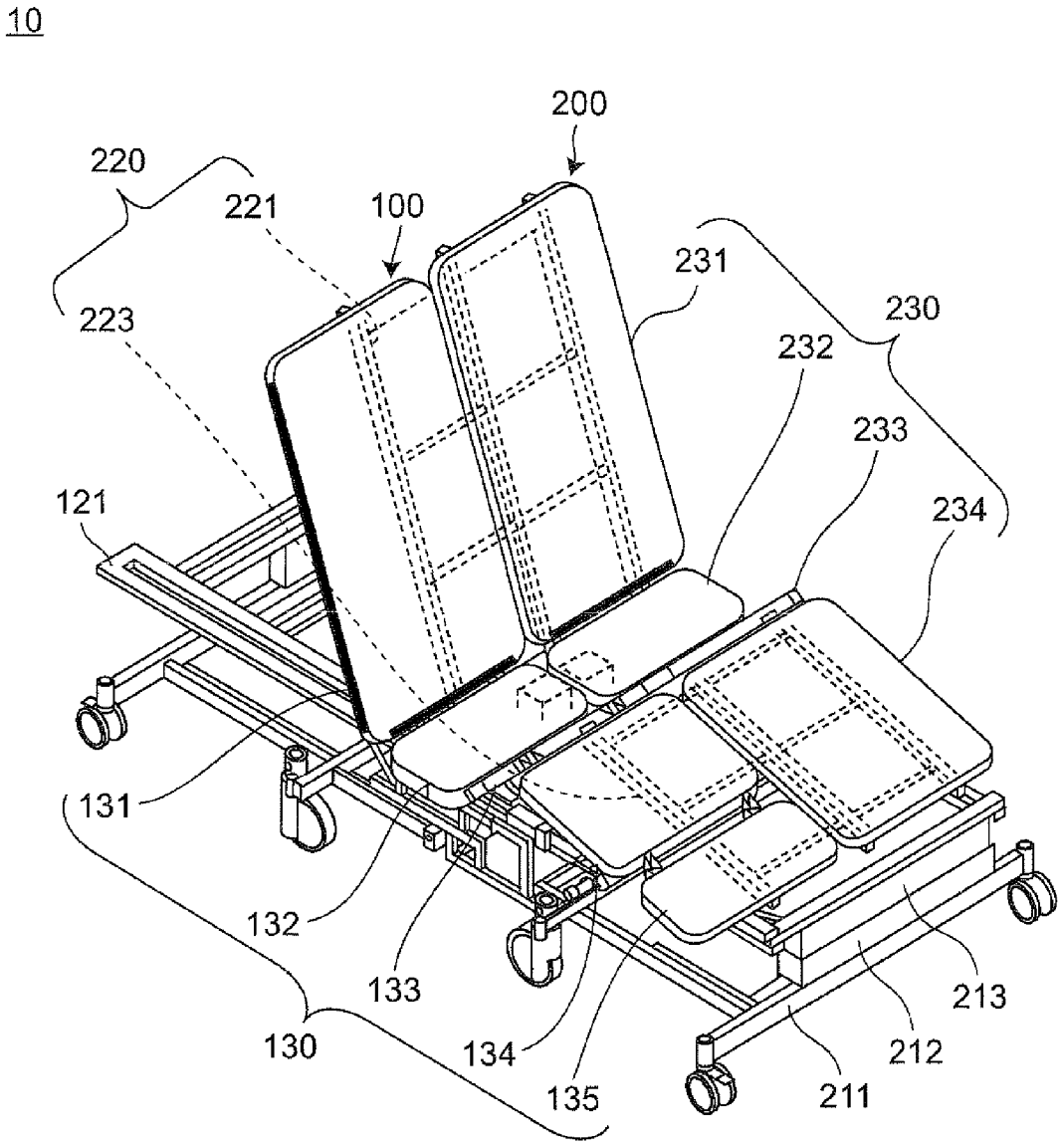
FIG. 7 is a perspective view of a knee lifting posture and a back lifting posture of the combined bed according to the first embodiment.
Figure 8:
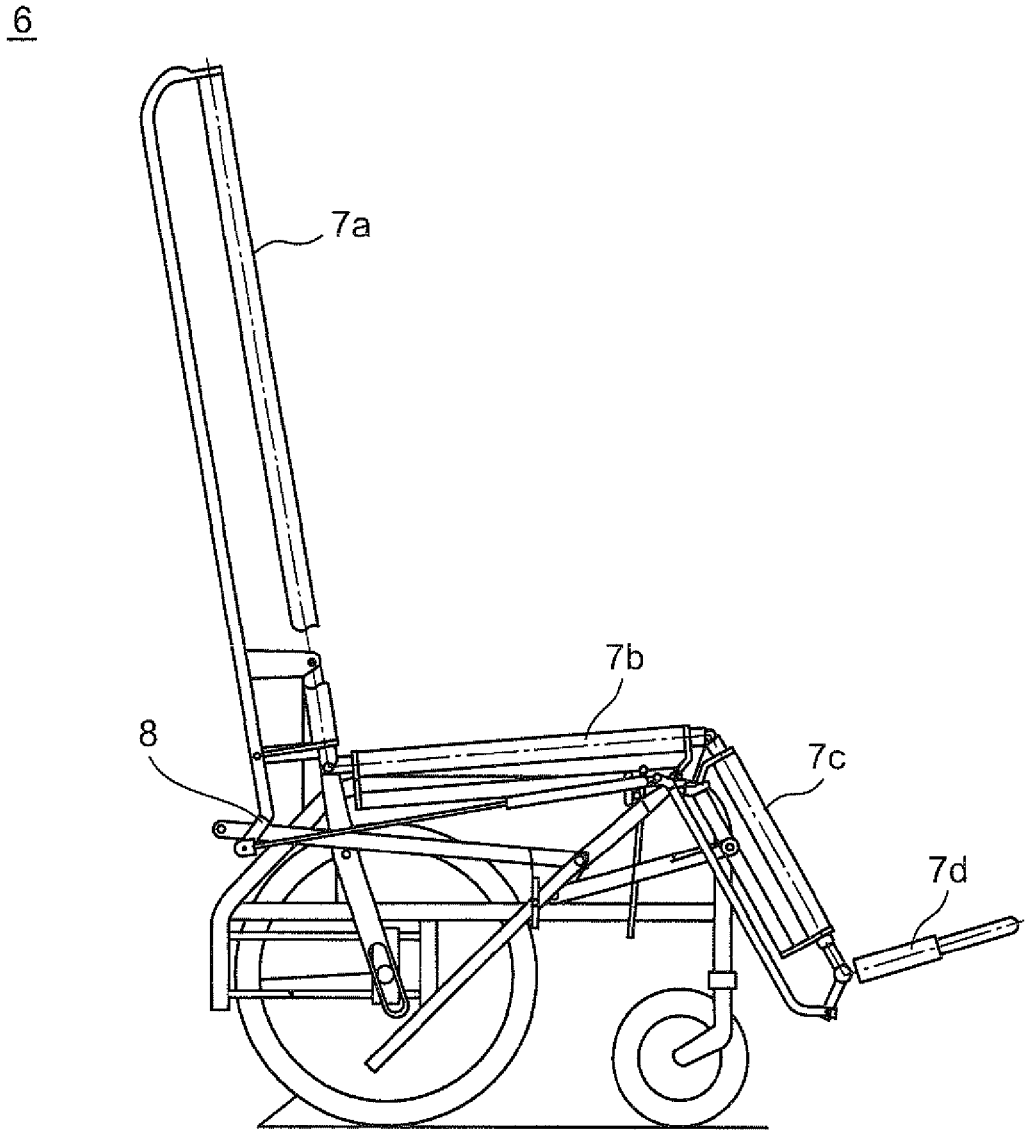
FIG. 8 is a side view of a chair posture of a wheelchair of Patent Literature 1.
Figure 9:
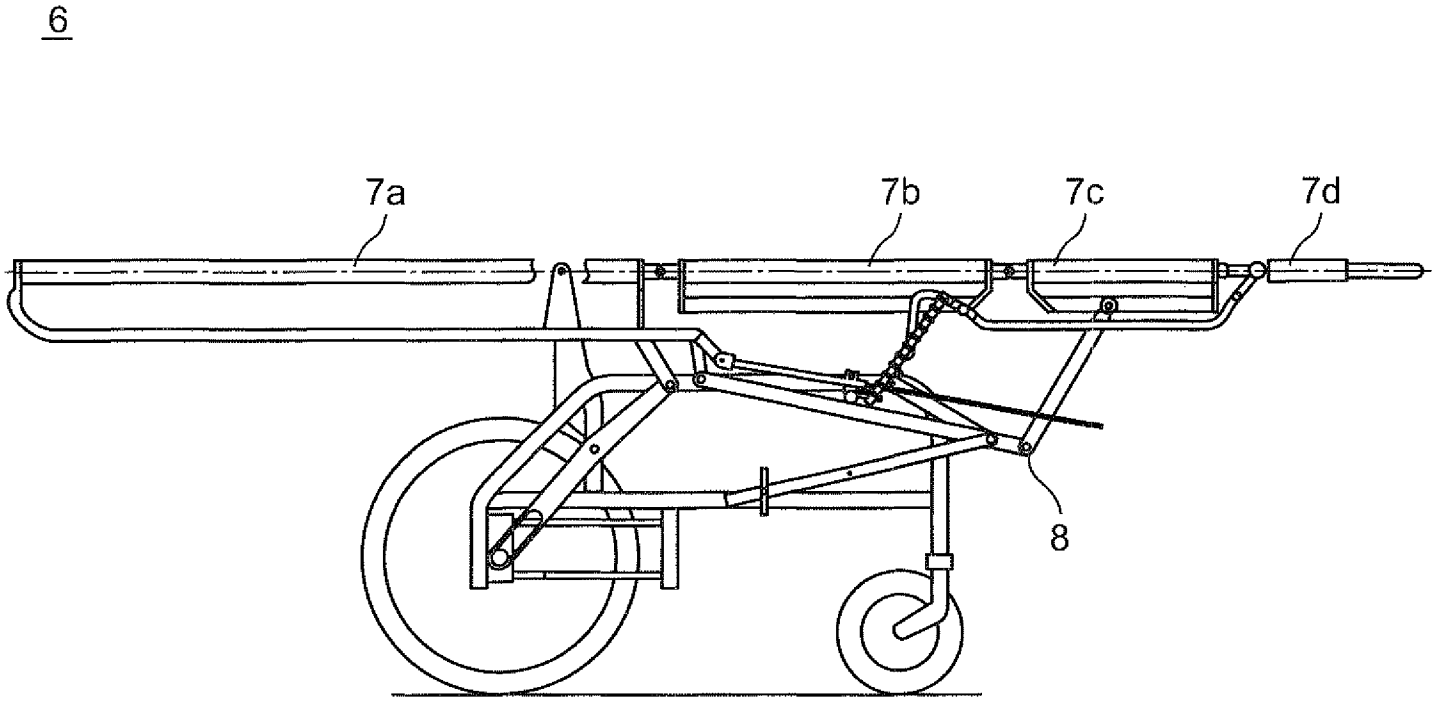
FIG. 9 is a side view of a flat posture of the wheelchair of Patent Literature 1.

FIG. 7 is a perspective view of the combined bed 10 that takes the back lifting posture and the knee lifting posture. As illustrated in FIG. 7, when the wheelchair 100 is combined with the bed portion 200, the wheelchair bottom portion 130 is supported along with the bed bottom portion 230 by the bed link portion 220. Then, when the posture is changed by the bed link portion 220, the wheelchair bottom portion 130 and the bed bottom portion 230 integrally change the posture according to the change of the posture of the bed link portion 220. In the wheelchair 100 that is not yet combined, the first bottom 131, the second bottom 133, the third bottom 134, and the fourth bottom 135 are supported by coming into contact with the first link 121, the second link 123, the third link 124, and the fourth link 125, respectively. Therefore, when the posture of the bed link portion 220 is changed from the flat posture to the back lifting posture and the knee lifting posture after the combination, a link that supports the bottom portion 130 is switched from the wheelchair link portion 120 to the bed link portion 220. Therefore, the change of the postures of the wheelchair bottom portion 130 and the bed bottom portion 230 can be performed only by the bed link portion 220. According to this configuration, the combined bed 10 can take the same posture as a regular caring bed when the wheelchair 100 is combined with the bed portion 200.

By appropriately combining arbitrary embodiments or modifications of the above various embodiments or modifications, respective effects can be produced. Additionally, combination between embodiments, combination between working examples, or combination between an embodiment(s) and a working example(s) is possible, and combination between characteristics in different embodiments or working examples is possible as well.

INDUSTRIAL APPLICABILITY

A wheelchair and a bed of the present invention are useful for an ordinary home, a hospital facility, or a caring facility where a person who needs to care lives.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A wheelchair comprising:

a wheelchair bottom portion constituted by coupling a first bottom, a fifth bottom, a second bottom, a third bottom, and a fourth bottom;

a first link configured to support the first bottom;

a second link configured to support the second bottom;

a third link configured to support the third bottom;

a fourth link configured to support the fourth bottom;

a first base portion configured to support the fifth bottom;

a first drive link configured to interlock and move the second link and the third link; and a first coupling link configured to couple the first link and the first drive link, and move the first drive link interlocking with movement of the first link, wherein the first drive link has a first end that is disposed with a first roller slidable with respect to the second link, and has a second end that is disposed with a second roller slidable with respect to the third link.

2. The wheelchair according to claim 1, wherein the second link and the third link each have a rail portion having a C-shaped cross section, and the first roller slides in the rail portion of the second link, and the second roller slides in the rail portion of the third link.

3. The wheelchair according to claim 1, wherein the first bottom is a bottom on a back side of the wheelchair, the second bottom is a bottom on a thigh side of the wheelchair, the third bottom is a bottom on a calf side of the wheelchair, the fourth bottom is a bottom on a foot side of the wheelchair, and the fifth bottom is a bottom on a hip side of the wheelchair, the first link is a link on the back side of the wheelchair, the second link is a link on the thigh side of the wheelchair, and the third link is a link on the calf side of the wheelchair, and the first roller is a sliding roller disposed on the thigh side of the wheelchair, and the second roller is a sliding roller disposed on the calf side of the wheelchair.

4. The wheelchair according to claim 2, wherein the first bottom is a bottom on a back side of the wheelchair, the second bottom is a bottom on a thigh side of the wheelchair, the third bottom is a bottom on a calf side of the wheelchair, the fourth bottom is a bottom on a foot side of the wheelchair, and the fifth bottom is a bottom on a hip side of the wheelchair, the first link is a link on the back side of the wheelchair, the second link is a link on the thigh side of the wheelchair, and the third link is a link on the calf side of the wheelchair, and the first roller is a sliding roller disposed on the thigh side of the wheelchair, and the second roller is a sliding roller disposed on the calf side of the wheelchair.

5. The wheelchair according to claim 3, wherein in a flat posture, and in a chair posture, the first roller slides between a start point position on the back side and an end point position on a toe side in a rail portion of the second link, and the second roller slides between a start point position on the back side and an end point position on a toe side in a rail portion of the third link.

6. The wheelchair according to claim 4, wherein in a flat posture, and in a chair posture, the first roller slides between a start point position on the back side and an end point position on a toe side in the rail portion of the second link, and the second roller slides between a start point position on the back side and an end point position on a toe side in the rail portion of the third link.

7. The wheelchair according to claim 5, wherein a rotating center of the first drive link is disposed on a side closer to a coupling point of the first drive link and the first coupling link than a line connecting a rotation center of the first roller and a rotation center of the second roller.

8. The wheelchair according to claim 6, wherein a rotating center of the first drive link is disposed on a side closer to a coupling point of the first drive link and the first coupling link than a line connecting a rotation center of the first roller and a rotation center of the second roller.

9. The wheelchair according to claim 1, wherein the wheelchair is combined with a bed portion to constitute a combined bed.

10. The wheelchair according to claim 2, wherein the wheelchair is combined with a bed portion to constitute a combined bed.

11. The wheelchair according to claim 1, wherein the wheelchair is combined with a bed portion to constitute a combined bed, the bed portion has a bed link portion configured to support a bed bottom portion, and a second base portion configured to fix the bed link portion, and in a combined state for constituting the combined bed, the wheelchair bottom portion is supported by the bed link portion, and the bed bottom portion and the wheelchair bottom portion integrally move to be interlocked with the bed link portion.

12. The wheelchair according to claim 2, wherein the wheelchair is combined with a bed portion to constitute a combined bed, the bed portion has a bed link portion configured to support a bed bottom portion, and a second base portion configured to fix the bed link portion, and in a combined state for constituting the combined bed, the wheelchair bottom portion is supported by the bed link portion, and the bed bottom portion and the wheelchair bottom portion integrally move to be interlocked with the bed link portion.

13. The wheelchair according to claim 9, wherein the bed portion has a bed link portion configured to support a bed bottom portion, and a bed base portion configured to fix the bed link portion, and in a combined state for constituting the combined bed, the wheelchair bottom portion is supported by the bed link portion, and the bed bottom portion and the wheelchair bottom portion integrally move to be interlocked with the bed link portion.

14. The wheelchair according to claim 10, wherein the bed portion has a bed link portion configured to support a bed bottom portion, and a bed base portion configured to fix the bed link portion, and in a combined state for constituting the combined bed, the wheelchair bottom portion is supported by the bed link portion, and the bed bottom portion and the wheelchair bottom portion integrally move to be interlocked with the bed link portion.

15. A combined bed comprising:

the wheelchair according to claim 1; and a bed portion having a bed bottom portion constituted by coupling a seventh bottom, an eighth bottom, a ninth bottom, and a tenth bottom, the bed portion being combined with the wheelchair to constitute the combined bed, wherein the bed portion has a lifting unit located below the third link at a time of combination and configured to lift the ninth bottom.

16. A combined bed comprising:

the wheelchair according to claim 2; and a bed portion having a bed bottom portion constituted by coupling a seventh bottom, an eighth bottom, a ninth bottom, and a tenth bottom, the bed portion being combined with the wheelchair to constitute the combined bed, wherein the bed portion has a lifting unit located below the third link at a time of combination and configured to lift the ninth bottom.

17. The combined bed according to claim 15, wherein the seventh bottom is a bottom on a back side of the bed portion, the eighth bottom is a bottom on a hip side of the bed portion, the ninth bottom is a bottom on a thigh side of the bed portion, and the tenth bottom is a bottom on a foot side of the bed portion.

18. The combined bed according to claim 16, wherein the seventh bottom is a bottom on a back side of the bed portion, the eighth bottom is a bottom on a hip side of the bed portion, the ninth bottom is a bottom on a thigh side of the bed portion, and the tenth bottom is a bottom on a foot side of the bed portion.

19. A combined bed comprising:

the wheelchair according to claim 9; and a bed portion having a bed bottom portion constituted by coupling a seventh bottom, an eighth bottom, a ninth bottom, and a tenth bottom, the bed portion being combined with the wheelchair to constitute the combined bed, wherein the bed portion has a lifting unit located below the third link at a time of combination and configured to lift the ninth bottom.

20. The wheelchair according to claim 19, wherein the seventh bottom is a bottom on a back side of the bed portion, the eighth bottom is a bottom on a hip side of the bed portion, the ninth bottom is a bottom on a thigh side of the bed portion, and the tenth bottom is a bottom on a foot side of the bed portion.

* * * * *